US006286778B1

(12) United States Patent
Kudrus

(10) Patent No.: US 6,286,778 B1
(45) Date of Patent: Sep. 11, 2001

(54) SPOOLING MACHINE FOR CONTINUOUSLY RUNNING FIBERS

(75) Inventor: Heiner Kudrus, Barmstedt (DE)

(73) Assignee: Neumag - Neumuenstersche Maschinen und Anlagenbau GmbH, Neumuenster (DE)

( * ) Notice: Subject to any disclaimer, the term of this patent is extended or adjusted under 35 U.S.C. 154(b) by 0 days.

(21) Appl. No.: 09/563,356

(22) Filed: May 3, 2000

(30) Foreign Application Priority Data

May 21, 1999 (DE) ..... 299 08 962 U

(51) Int. Cl.[7] ..... B65H 54/40; B65H 67/048
(52) U.S. Cl. ..... 242/486.6; 242/474.5
(58) Field of Search ..... 242/474.6, 474.5, 242/474.4, 486.1, 486.6

(56) References Cited

U.S. PATENT DOCUMENTS 3,999,715 * 12/1976 Schippers et al. ..... 242/474.6
4,069,985 * 1/1978 Lohest et al. ..... 242/486.6 X
4,602,747 * 7/1986 Turk et al. ..... 242/474.6
4,917,319 * 4/1990 Lenk ..... 242/474.5
4,963,778 * 10/1990 Jensen et al. ..... 310/68 D
5,029,762 * 7/1991 Behrens et al. ..... 242/474.5 X
5,526,995 * 6/1996 Westrich et al. ..... 242/474.5
5,927,636 * 7/1999 Rafflenbeul ..... 242/474.4 X

FOREIGN PATENT DOCUMENTS 0 845 432 A1 6/1998 (EP) .

* cited by examiner

*Primary Examiner*—Michael R. Mansen
(74) *Attorney, Agent, or Firm*—Michael J. Striker

(57) ABSTRACT

The spooling machine for continuously running fibers has a housing (1) with a support arm (2) extending from its upper portion; spindles (7,8) for fixing a number of bobbins (11) for the continuously running fibers; a rotatable spindle revolver (4) on which said spindles are rotatably mounted; a changing device (14) including changing units (15,16,17) corresponding in number to the fibers; respective variable speed motors (9,18) for rotatably driving the spindles (7,8) and the changing device (14) and a control unit (20) mounted on a free end of the support arm (2). In order to avoid electrical interference between the frequency converters and other electronic equipment each of the variable speed motors for the spindles and the changing device have an integrated frequency converter **(9*a*,18*a*). The control unit (20)** controls momentary frequencies of the frequency converters and also spooling machine operations.

4 Claims, 1 Drawing Sheet

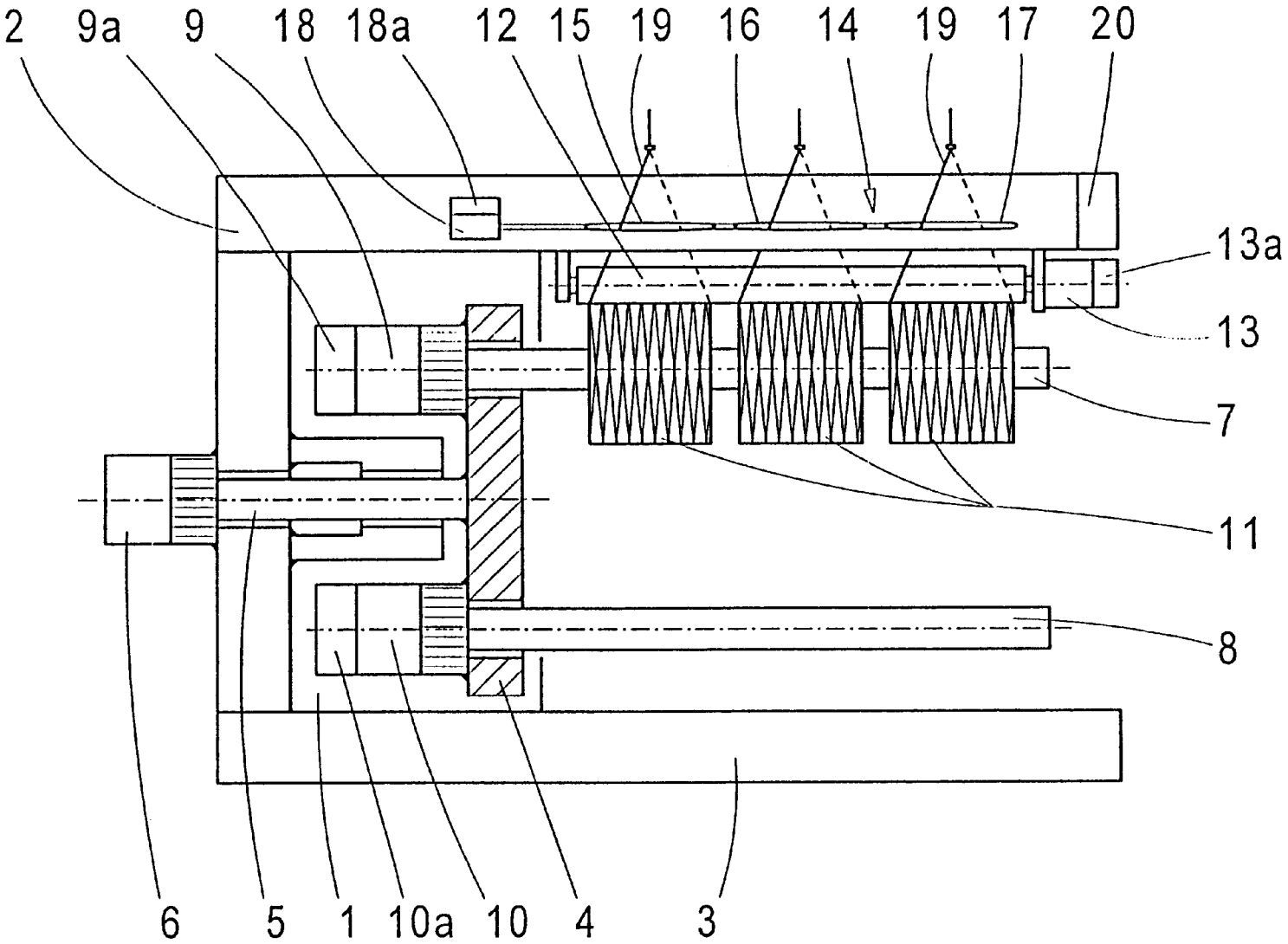
20
17
19
14
16
19
15
12
18a
18
9
9a
2
13a
13
7
11
8
3
4
10
10a
1
5
6

SPOOLING MACHINE FOR CONTINUOUSLY RUNNING FIBERS

BACKGROUND OF THE INVENTION

1. Field of the Invention

The present invention relates to a spooling machine for continuously running fibers and, more particularly, to a spooling machine for holding a number of bobbins for the continuously running fibers, a changing device including a number of changing units corresponding to the number of fibers and a plurality of variable speed motors for the spindles and the changing units supplied by frequency converters.

2. Prior Art

A spooling machine of the above-described type is disclosed in EP 0 845 432. Drive electronics and control electronics are assembled into a single electronic unit in this known spooling machine. This single electronic unit is mounted on a horizontal support arm, on which the changing device also is arranged. Frequency converters particularly are part of the drive electronics.

The respective frequency converters are connected with the various corresponding drive means by cable. In order to avoid electronic interaction of the supply electronics with the control electronic or on other electric units found in the surroundings, the cable must be carefully shielded. Special problems exist in spooling machines, which are equipped with a spool revolver, carrying ground ring contacts, with which energy is transferred from stationary machine parts to the rotating revolver. Other problems result from the heat losses of the various frequency converters occurring in the comparatively narrow space. Additional features are thus required that guarantee sufficient cooling.

SUMMARY OF THE INVENTION

It is an object of the present invention to provide a spooling machine of the above-described type for continuously running fibers that does not have the above-described disadvantages.

This object and others, which will be made more apparent hereinafter, are attained in a spooling machine comprising at least one spindle for fixing or holding respective bobbins for a corresponding number of the continuously running fibers, a changing device including a number of changing units corresponding to the number of continuously running fibers and respective variable speed motors for rotatably driving the at least one spindle and the changing device.

According to the invention each variable speed motor for the at least one spindle and changing device has an integrated frequency converter. The frequency converters for the spindles and changing units are no longer arranged in the electronic unit with the control electronics.

The term "integrated" frequency converter means that the variable speed motor and frequency converter are in one unit, e.g. the frequency converter is mounted like a terminal box on the motor housing.

In a preferred embodiment of the invention the one or more spindles are rotatably mounted on a rotatable spindle revolver.

In another embodiment a contact roll is provided over which the fibers pass to the bobbins. The contact roll is also driven rotatably by means of another variable speed motor with an integrated frequency converter.

BRIEF DESCRIPTION OF THE DRAWINGS

The objects, features and advantages of the invention will now be illustrated in more detail with the aid of the following description of the preferred embodiment, with reference to the accompanying sole FIGURE, which is a vertical cross-sectional view through a spooling machine according to the invention.

DESCRIPTION OF THE PREFERRED EMBODIMENTS

The spooling machine shown in the drawing has a machine frame. The machine frame comprises a box-like housing 1, a horizontally extending support arm 2 connected with the upper portion of the housing 1 and a stand 3, which is located essentially under the support arm 2 and extends over its entire length.

A rotatable spool revolver 4 is arranged in the housing 1. Its drive shaft 5 passes through a side wall of the housing 1 and is connected with a motor 6, e.g. a stepping motor.

Two spindles 7,8 are rotatably mounted on the plate-like revolver 4. The two spindles 7,8 are arranged mirror symmetrically in relation to the axis of rotation of the revolver 4. Each spindle 7,8 is connected with a variables speed motor 9,10. The motors 9,10 are either synchronous motors or asynchronous motors with regulated rotation speed. Three bobbins 11 sit on the upper spindle 7. The bearings of a contact roll 12 are attached to the support arm 2, which is similarly connected with another variable speed motor 12. Furthermore a changing device 14 is mounted on the support arm 2. This changing device 14 comprises several changing units 15, 16, 17, for example blade changers of the known type, according to the number of bobbins. The changing units 15, 16, 17 are driven by a common motor 18, for example by a belt drive.

The variable speed motors 9, 10, which are connected with the spindles 7,8, the common motor 18 and the motor 13 for the contact roll 12 are equipped with integrated frequency converters 9*a*, 10*a*, 13*a* and 18*a*. The respective frequency converter is mounted, like a terminal box, directly on the corresponding motor and connected with by a plug contact without intervening cable. The wiring of the motor with integrated converter is limited to a simple power line for the converter and a control line. Motors of this type with integrated frequency converters are available commercially as compact units, for example Siemans Kombimaster. The motor parts are adapted to each other to obtain optimum performance by the manufacturer.

In operation, the fibers are supplied at constant speed. They travel toward the contact roll 12 downstream from the changing device 14 in the fiber running direction, are slung around it on a portion of its circumferences and are deposited on the surfaces of the bobbins 11. The contact roll 12 rotates essential at a constant rotation speed, only with slight control fluctuations superimposed thereon, so that the speed of the surface of the contact roll 12 corresponds to the speed at which fibers are supplied. The spindle 7 rotates with a rotation speed that is decreasing inversely proportional to the increasing diameters of the bobbins, so that their surface speed is always constantly equal to the speed at which the fibers are supplied. The spindle 8 is idle in the state illustrated in the drawing. The revolver 4 changes its angular position slowly so that the bobbins 11 contact with a slight pressure on the contact roll 12 during the entire spooling operation. When the bobbins 11 on the spindle 7 reach a predetermined diameter, bobbin changing occurs in a known manner. The spindle 8, which has been provided with empty bobbin sleeves during the previously described spooling operation, is brought into a close contact with the contract roll 12 by a rotation of the revolver 4, and the fibers are placed on the empty sleeves of the ready bobbins 11 and cut. Thus a new spooling operation begins, this time with the spindle 8 in operation and with the spindle 7 standing by.

A control unit 20, which is mounted on an end of the support arm 2, controls the spooling machine operations. Particularly the momentary frequencies of the various frequency converters are set by means of the control unit 20.

The disclosure in German Patent Application 299 08 962.2 of May 21, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a spooling machine for continuously running fibers, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A spooling machine for continuously running fibers, said spooling machine comprising a housing (1) with a horizontally extending support arm (2) connected with an upper portion of the housing (1);

at least one spindle (7,8) for holding a number of bobbins (11) for the continuously running fibers;

a changing device (14) including a plurality of changing units (15,16,17) corresponding to the number of fibers;

respective variable speed motors (9,18) for rotatably driving the at least one spindle (7) and the changing device (14), said variable speed motors having respective integrated frequency converters **(9*a*, 18*a*); and a control unit (20) mounted on an end of said support arm (2), said control unit (20)** comprising means for controlling momentary frequencies of said respective integrated frequency converters and spooling machine operations, so that said frequency converters are separate from said control unit in order to guarantee sufficient cooling.

2. The spooling machine as defined in claim 1, further comprising a rotatably driven spindle revolver (4) mounted in said housing (1) and wherein said at least one spindle (7,8) is rotatably mounted on the spindle revolver (4).

3. The spooling machine as defined in claim 1, further comprising a rotatable contact roll (12) around which said fibers pass to said bobbins (11) and another motor (13) connected with said contact roll (12) to rotate said contract roll (12) and wherein said another motor (13) has an integrated frequency converter **(13*a*) and said rotatable contact roll (12) is rotatably mounted under said support arm (2)**.

4. A spooling machine for continuously running fibers, said spooling machine comprising a housing (1) with a horizontally extending support arm (2) connected with an upper portion of the housing (1);

a plurality of spindles (7,8) for fixing respective bobbins (11) for the continuously running fibers;

a changing device (14) including a plurality of changing units (15,16,17) corresponding to the number of fibers, said changing device being arranged on said support arm (2);

a rotatable spindle revolver (4) on which said spindles are rotatably mounted;

respective variable speed motors (6,9,18) for rotatably driving the spindles (7,8), the spindle revolver (4) and the changing device (14), said variable speed motors (9,18) for the spindles and the changing device having respective integrated frequency converters **(9*a*,18*a*); and a control unit (20) mounted on an end of said support arm (2), said control unit (20)** comprising means for controlling momentary frequencies of said respective integrated frequency converters and spooling machine operations, so that said frequency converters are separate from said control unit in order to guarantee sufficient cooling.

* * * * *